US007021648B2

(12) United States Patent
Deborde et al.

(10) Patent No.: US 7,021,648 B2
(45) Date of Patent: Apr. 4, 2006

(54) BOARD FOR GLIDING

(75) Inventors: Henri-Charles Deborde, Bilieu (FR); Alain Zanco, La Buisse (FR); Milena Stefanova, Saint Barthelemy de Sechilienne (FR); Jacques Fagot, Saint Jean de Moirans (FR); Michel Echevin, Meylan (FR)

(73) Assignee: Skis Rossignols S.A., Voiron (FR)

( * ) Notice: Subject to any disclaimer, the term of this patent is extended or adjusted under 35 U.S.C. 154(b) by 311 days.

(21) Appl. No.: 10/078,910

(22) Filed: Feb. 20, 2002

(65) Prior Publication Data

US 2002/0113410 A1 Aug. 22, 2002

(30) Foreign Application Priority Data

Feb. 20, 2001 (FR) ..... 01 02283

(51) Int. Cl.
*A63C 5/04* (2006.01)

(52) U.S. Cl. ..... 280/607

(58) Field of Classification Search ..... 280/602, 280/607, 608, 609, 610, 617, 809
See application file for complete search history.

(56) References Cited

U.S. PATENT DOCUMENTS

| | | | | | |
|---|---|---|---|---|---|
| 4,300,786 | A | * | 11/1981 | Alley | 280/602 |
| 4,725,070 | A | * | 2/1988 | Maruyama | 280/610 |
| 5,232,241 | A | | 8/1993 | Knott et al. | 280/607 |
| 5,280,943 | A | * | 1/1994 | Commier et al. | 280/609 |
| 5,333,889 | A | | 8/1994 | Piegay et al. | 280/602 |
| 5,366,234 | A | | 11/1994 | Rohrmoser | 280/610 |
| 5,393,086 | A | * | 2/1995 | Le Masson et al. | 280/602 |
| 5,397,150 | A | | 3/1995 | Commier et al. | 280/607 |
| 5,427,401 | A | | 6/1995 | Liard | 280/609 |
| 5,470,094 | A | * | 11/1995 | Commier et al. | 280/602 |
| 5,553,884 | A | | 9/1996 | Abondance | 280/609 |
| 5,871,223 | A | | 2/1999 | Zanco | 280/607 |
| 5,944,336 | A | | 8/1999 | Fagot | 280/607 |
| RE36,586 | E | * | 2/2000 | Abondance et al. | 280/602 |

(Continued)

FOREIGN PATENT DOCUMENTS

| | | | | |
|---|---|---|---|---|
| DE | 682623 | * | 9/1939 | 280/610 |
| DE | 3937617 | | 7/1990 | |
| DE | WO 99/38583 | | 8/1999 | |
| EP | 490044 | * | 6/1992 | 280/602 |
| EP | 0620028 | | 10/1994 | |
| FR | 2698012 | * | 5/1994 | 280/602 |
| FR | 2781166 | | 7/1998 | |
| FR | 2786403 | | 11/1998 | |
| FR | 2 775 437 | | 3/1999 | |
| JP | 253328 | | 5/1993 | |
| JP | 5-277220 | | 10/1993 | |

*Primary Examiner*—Frank Vanaman
(74) *Attorney, Agent, or Firm*—Heslin Rothenberg Farley & Mesiti P.C.; Victor A. Cardona, Esq.

(57) ABSTRACT

A board for gliding for downhill skiing, having, at least in its underfoot zone:

a lower gliding surface composed of a sole plate bordered by metal edges;

a topsheet substantially parallel to the lower gliding surface, on either side of the center longitudinal plane of the board;

lateral reinforcement elements located in line with at least one part of the bead of the metal edges;

lateral faces extending between the top part of the lateral reinforcement elements and the topsheet, said lateral faces having recesses located below the plane of the topsheet and opening out in the latter;

wherein these recesses form a hollowed zone connected to the reinforcement elements, and wherein the lower part of the recesses has a slope that is inclined longitudinally relative to the lower gliding surface and the topsheet.

26 Claims, 4 Drawing Sheets

U.S. PATENT DOCUMENTS

| | | | | |
|---|---|---|---|---|
| 6,158,747 | A | 12/2000 | Magnani | 280/11.14 |
| 6,193,262 | B1 | 2/2001 | Silva | 280/607 |
| 6,217,055 | B1 | 4/2001 | Silva | 280/607 |
| 6,227,558 | B1 | 5/2001 | Arduin et al. | 280/611 |
| 6,237,932 | B1 * | 5/2001 | Zanco et al. | 280/602 |
| 6,257,612 | B1 | 7/2001 | Zanco et al. | 280/607 |
| 6,412,807 | B1 | 7/2002 | Arduin et al. | 280/607 |
| 6,481,741 | B1 | 11/2002 | Porte | 280/609 |
| 2001/0010420 | A1 | 8/2001 | Arduin et al. | 280/611 |
| 2001/0022439 | A1 | 9/2001 | Andrus et al. | 280/610 |
| 2001/0035630 | A1 | 11/2001 | Cuzzit et al. | 280/609 |
| 2002/0014757 | A1 | 2/2002 | Silva | 280/607 |
| 2002/0047250 | A1 | 4/2002 | Luitz et al. | 280/607 |
| 2002/0117832 | A1 | 8/2002 | Gatel | 280/617 |
| 2003/0025299 | A1 | 2/2003 | Noviant | 280/607 |
| 2003/0085550 | A1 | 5/2003 | Godde et al. | 280/617 |

* cited by examiner

BOARD FOR GLIDING

CROSS REFERENCE TO RELATED APPLICATIONS

This application claims the priority of French application FR/01.02283, filed Feb. 20, 2001, the entire disclosure of which is incorporated herein by reference.

TECHNICAL FIELD

The invention relates to the field of sports involving gliding over snow and, more particularly, downhill skiing. It relates more specifically to downhill skis of which the topsheet in the underfoot zone is not totally planar, but, on the contrary, has lateral recesses in the region of the upper ridges.

PRIOR ART

Generally speaking in its underfoot zone, a downhill ski has at least one lower gliding surface composed of a sole plate bordered by metal edges. It also includes a topsheet which is substantially parallel to the lower gliding surface, on either side of the longitudinal center plane of the ski.

There are two main families of structures which make it possible to produce current downhill skis. In a first family, the structure comprises a shell of trapezoidal general section, which connects one edge to the other by capping the component elements of the structure.

In a second family, the structure includes lateral reinforcement elements which form at least one part of the lateral faces of the ski. These reinforcement elements are generally visible and form the sides of the ski over all or part of its thickness.

These reinforcement elements are located in line with the edges and, more precisely, the thicker part of the edges which is adjacent to the gliding sole plate, also known as the "bead". Thanks to these reinforcement elements, the bearing forces exerted on the topsheet of the ski are more efficiently transmitted to the edges and thus allow better gripping.

Described in document FR 2 703 916 is a board for gliding which has such reinforcement elements and which also has recesses made in the region of the lateral faces extending between the top part of the reinforcement elements and the topsheet of the ski.

More precisely, the ski described in this document has a height differential between the central part of its topsheet and the lateral zones. This differential forms a recess made above the reinforcement element.

This reinforcement element has a height that is substantially constant over the entire length of the ski, so that the recesses made in the region of the underfoot zone have a base that is substantially parallel to the gliding sole plate.

The aim of the invention is to provide a ski which has a geometry derived from that described above and with superior dynamic behavior qualities, particularly regarding the linking of the various phases of a turn.

SUMMARY OF THE INVENTION

The invention thus relates to a board for gliding for downhill skiing which in a known manner, has, at least in its underfoot zone:

a lower gliding surface composed of a sole plate bordered by metal edges;

a topsheet substantially parallel to the lower gliding surface, on either side of the center longitudinal plane of the board;

lateral reinforcement elements located in line with at least one part of the bead of the metal edges;

lateral faces extending between the top part of the reinforcement elements and the topsheet, said lateral face having recesses located below the plane of the topsheet and opening out in the latter.

According to the invention, this board is noteworthy in that the recesses form a hollowed zone connected to the reinforcement elements, and wherein the lower part of these recesses has a slope that is inclined longitudinally relative to the lower gliding surface and the topsheet.

In other words, the characteristic recesses form a hollowed zone inside the lateral reinforcement elements which thus have a reduced height that can vary in the region of these recesses. The board thus has, in the region of these sides, a continuous diminution in its thickness. This gives rise to a partial and localized variation of stiffness in the zone of the recess. Consequently, the behavior of the board is modified as a function of the location of the point of application of the forces exerted by the skier, this location depending greatly, in particular, on the position adopted by the skier during the various phases of a turn.

The characteristic recesses may assume different shapes.

Thus, the lower part of the recesses, i.e. their base, may be inclined either toward the front and the bottom of the ski or toward the rear and the bottom of the ski. In this latter case, the gradient of the longitudinal section in the lateral reinforcement element moves the bearing pressure toward the front of the ski during a turn since the partial stiffness of the ski is greater to the front than to the rear of the recess. This therefore improves execution of the turn because edge-gripping during initiation of the turn is more efficient.

The inclined slope of the base of the recesses may also have various geometries. Thus, the lower part of the recesses may have a slope which is either substantially constant over the greater part of its length or, alternatively, a slope that can vary over the length of the recess. In other words, the inclined base of the recess may be either planar or curved.

According to another characteristic of the invention, the lateral zones of the board can include different materials, in front and to the rear of the characteristic recess. The choice of different materials makes it possible to confer different mechanical properties on the zones directly to the front and to the rear of the characteristic recess.

Thus, in a first embodiment, one of the materials present in one of the lateral zones may be of a viscoeleastic nature, so as to confer damping properties on the lateral zone in question.

Conversely, one of the materials present in the lateral zones may be of an elastic nature, so as to confer dynamizing properties on the lateral zone in question.

These particular materials may be incorporated into the lateral zones as a function of the different geometries. Thus, when this is, for example, a viscoelastic material, this may be incorporated into the ski in the form of a spindle piece arranged above the lateral reinforcement element.

When this is an essentially elastic material, this may form a number of elements located inside slots made in the lateral zone in question. In this way, when the board bends, the various slots tend to close up, compressing the material contained by the board. When the cause of the bending disappears, the elastic elements located inside the slots exert a force which tends to open up the slot so that it regains its initial geometry. This acceleration of the return into position is thus reflected in a dynamizing of the board, which favors more sports-style skiing.

In practice, the slots may have a V- or Y-shaped profile, or a rectangular profile or, alternatively, a combination of these various geometries.

According to the type of behavior it is desired to obtain, the zone having damping properties is located either to the front or to the rear of the recess, and the lateral zone having dynamizing properties either to the rear or to the front of the recess.

In a particular embodiment, the characteristic recesses may have a width, measured transversely to the board, which can vary over the length of the recess. It is thus possible to optimize the partial variation in stiffness of the board.

In certain variant embodiments, the board for gliding may include a number of recesses made on the same side of the board. These recesses, numbering two or three, may have gradients oriented in the same direction or, in a preferred embodiment, in opposite directions.

Thus, in a particular embodiment, the board has two recesses on each side. The recess located to the front has a gradient oriented toward the bottom and toward the front. The recess located at the rear has a gradient oriented toward the top and toward the front (or, in an equivalent manner, toward the bottom and toward the rear.)

Such a board may, in particular, be equipped with a raising platform for the binding, which includes lateral portions of which the lower edge comes into contact or faces the base of the recess, with an inclined slope which complements that of the base of the recess.

BRIEF DESCRIPTION OF THE FIGURES

The way in which the invention is embodied and also the advantages arising therefrom will become clearly apparent from the description of the following embodiments, supporting the appended figures, in which.

IMPLEMENTATION OF THE INVENTION

Figure 1:
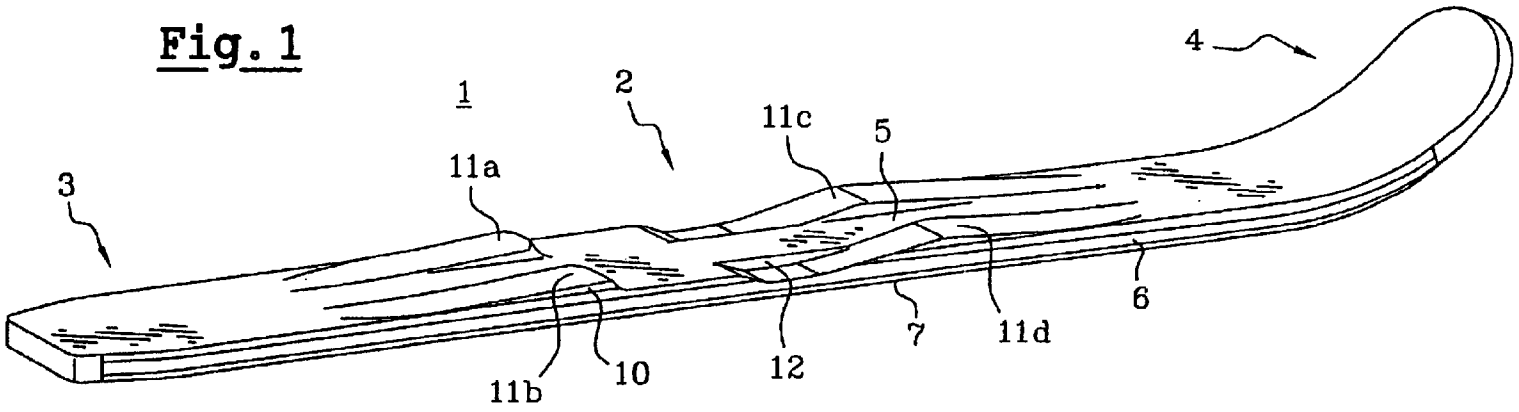
FIG. 1 is a summary perspective view of a ski according to the invention.

As already stated, the invention relates to a ski which has a particular structural feature in its underfoot zone. More precisely, as illustrated in FIG. 1, the ski (1) comprises an underfoot zone (2), a heel zone (3), and a tip zone (4).

In the underfoot zone (2), the ski includes a topsheet (5) which is intended for receiving the toe stop and the heel piece of the binding, optionally by means of a raising platform. This topsheet (5) is substantially planar on either side of the center longitudinal plane of the ski.

On each side, the ski (1) includes a reinforcement element (6) forming the side of the ski. This lateral reinforcement element (6) extends over the greater part of the length of the board, from the heel zone (3) to the tip zone (4). This lateral reinforcement element (6) is located in line with the edges (7) present on the lower ridges of the ski. This lateral reinforcement element (6) allows the transmission of the bearing forces from the topsheet (5) of the ski toward the edges (7) and, more precisely, the bead (8) of these edges, which constitutes the portion of the edges (7) which comes directly into contact with the snow and is present on the lower ridge of the board.

As illustrated in FIG. 1, the board comprises lateral faces (10) which extend between the top part of the reinforcement elements 6 and the topsheet (5) of the board.

Figure 2:
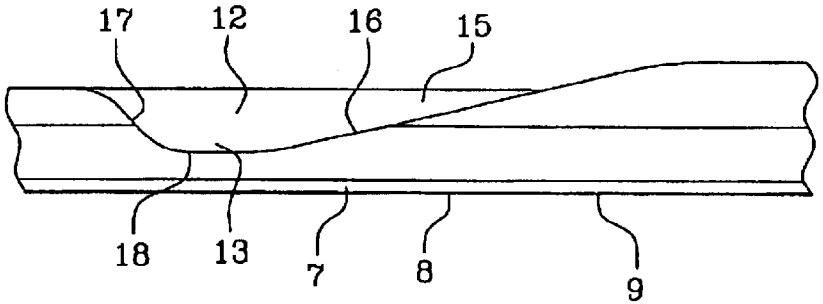
FIG. 2 is a detailed side view of the ski of FIG. 1, shown in the characteristic zone of the invention.

According to the invention, these lateral faces (10) include recesses (12) which open out in the topsheet (5). According to a characteristic of the invention, these recesses (12) form a hollowed zone (13) inside the reinforcement elements (6), as illustrated in FIG. 2. This recess (12) is delimited principally by three surfaces, namely a substantially vertical first surface (15), the top part of which joins the topsheet (5) of the ski. The recess (12) also includes a base (16) which forms a slope which is inclined relative to the gliding surface (9) and to the topsheet (5) of the ski. This inclined base (15) extends to the rear via a portion (17) which is connected to the topsheet (5) of the ski to the rear of the recess (12).

The deepest zone (18) of the recess forms the limit between the inclined slope (16) and the portion (17) connecting to the topsheet (5).

Figure 3:
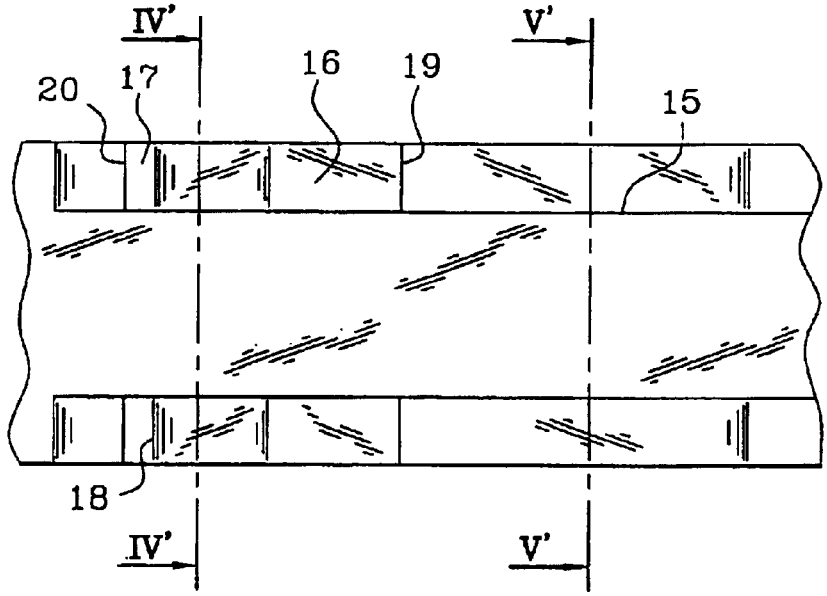
FIG. 3 is a top view of FIG. 2.

As illustrated in FIG. 3, the limits (19, 20) of the hollowed zone (13) formed in the lateral reinforcement element (6) can be observed. In practice, these limits (19, 20) may be concealed under a protective layer (not shown), the essential aim being to prevent water infiltrating between the lateral reinforcement element (6) and the rest of the structure.

In practice, the slope of the inclined base (16) of the recess (12), measured relative to the gliding surface (9), is between 1 and 20°, and preferably between 2° and 5°.

Figure 4:
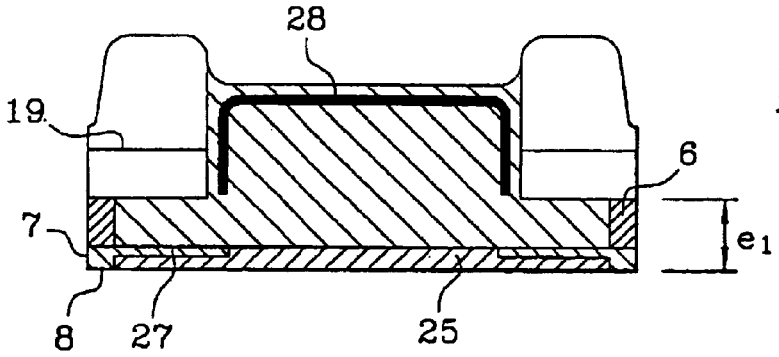
FIGS. 4 and 5 are, respectively, sections in the planes IV–IV' and V–V' of FIG. 3.
Figure 5:
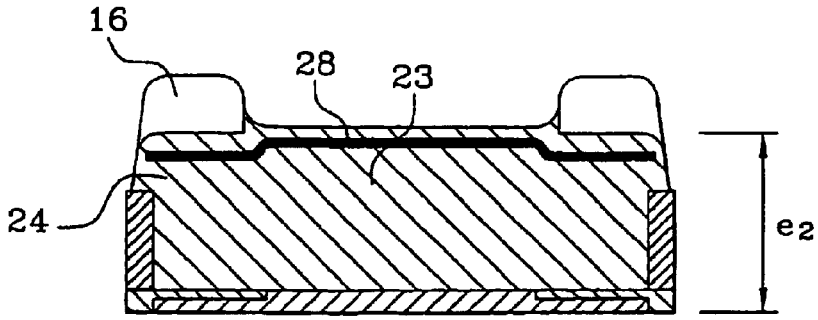

Thus, as illustrated by comparing FIGS. 4 and 5 which are sections, respectively, in the planes IV–IV' and V–V' of FIG. 3, the thickness el of the board, measured in the region of its sides, substantially in the lowest region (18) of the recess (12), is less than the thickness e2 measured more to the front of the recess.

In the first case, illustrated in FIG. 4, the thickness el corresponds to the thickness of the lateral reinforcement element (6) to which is added the thickness of the bead (8) of the edges (7) in which the sole plate (25) is positioned. The lateral reinforcement element (6) is generally narrower than the recess (12) and has, for example, a width equivalent to that of the edge bead (8).

As illustrated in FIG. 5, and more to the front of the recess (12), the board comprises not only the lateral reinforcement element (6) taken at its maximum height, but also a part (24) of the internal structure (23) of the board, which extends above the reinforcement elements (6).

In the embodiments illustrated in FIGS. 4 and 5, the board comprises, in its internal structure, an upper reinforcement (28) which takes on various shapes along the board and which extends more or less laterally, as a comparison of FIGS. 4 and 5 shows.

Of course, the invention is not limited just to the embodiments illustrated, but also covers the variant embodiments in which the inclined slope of the base of the recess is oriented in the opposite direction, i.e. toward the rear and toward the top. In this case, the deepest zone of the recess is located more to the front part of the latter, while, in the figures illustrated, this deepest zone (18) is located more to the rear of the recess (12).

The invention also covers other variant embodiments in which the width of the recesses is not constant but can vary over the length of the recess.

The invention is not limited either to the embodiment illustrated in FIG. 2, in which the base (16) of the recess (12) is substantially planar, but it encompasses, on the contrary, all the variant embodiments relating to the geometry of the base of the recess and, for example a curved base, since the base of this recess is not parallel to the gliding surface and to the topsheet of the ski.

In the embodiment illustrated in FIG. 1, the board also has four bosses (11*a*, 11*b*, 11*c*, 11*d*) arranged to the front and to the rear of each recess (12). These optional bosses move the bearing forces of the underfoot zone toward the tip and heel zones.

According to another aspect of the invention, the ski according to the invention has, to the front and to the rear of the recess (12), lateral zones which include different materials.

Figure 6:
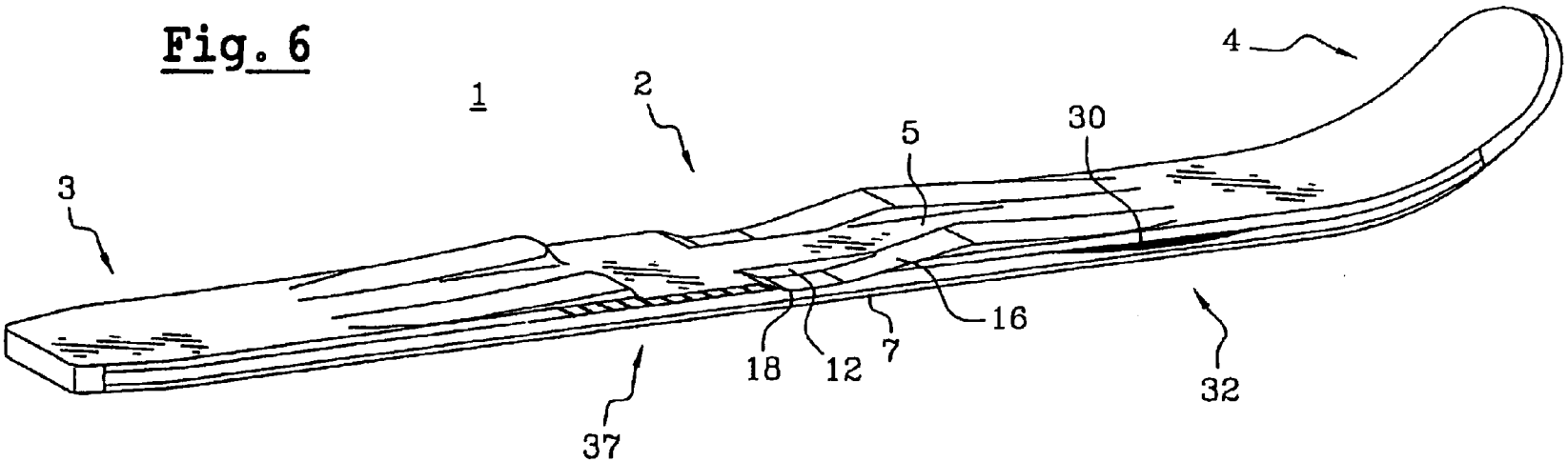
FIG. 6 is a summary perspective view of a ski produced according to an improved variant embodiment.

Thus, and as illustrated in FIG. 6, the ski comprises to the front of the recess (12) a spindle piece (30) which includes a viscoelastic material.

Figure 7:
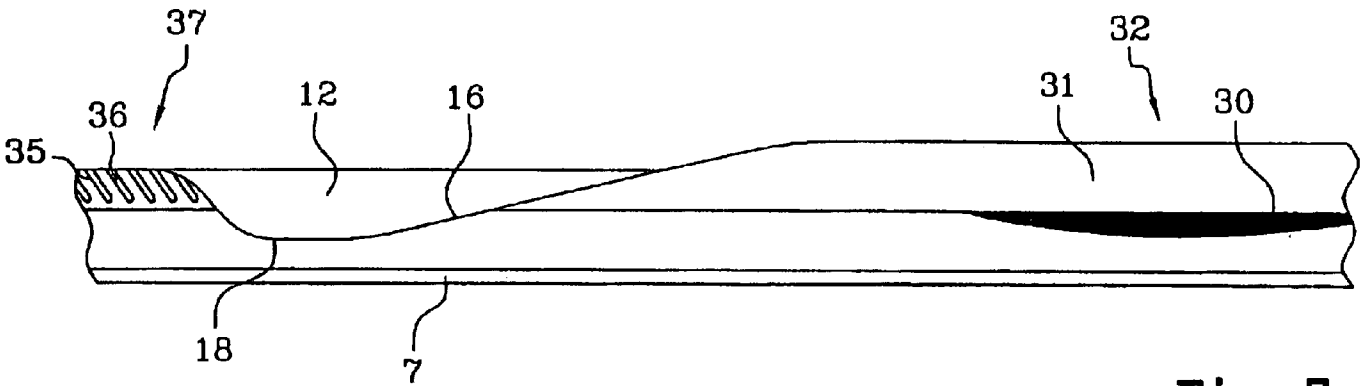
FIG. 7 is a detailed side view of the ski of FIG. 6, shown in the underfoot zone.

As illustrated in FIG. 7, this spindle piece (30) may be inserted above the reinforcement element (6) and below the portion (31) which forms the top of the structure of the board.

This spindle piece (30) may rest, for example, on the lateral reinforcement element (6) or, alternatively, be inserted inside a hollowed zone made in this reinforcement element or, again alternatively, rest on the lateral reinforcement element in order to form a hollowed zone in the structural portion (31).

The presence of this spindle piece (30) made from viscoelastic material confers damping properties on this localized zone of the board. In this way, a portion of the vibrations passing through this zone are absorbed by this spindle piece (30). Moreover, this spindle piece (30) absorbs a portion of the energy needed for bending the ski in the zone in which it is installed, which modifies the local stiffness of the ski. If this spindle piece (30) is installed as in the embodiment illustrated in FIGS. 6 and 7, to the front of the recess, this modified partial stiffness facilitates the initiation of a turn and improves comfort.

In the embodiment illustrated in FIG. 7, the lateral zone (37) of the ski has, to the rear of the recess, different slots (35) filled with an elastic material (36). These various slots (35) are hollowed, being slightly oriented toward the rear and the top of the board.

In the embodiment illustrated, these slots have a general U shape, including two principal parallel walls, but the invention also covers the variant embodiments in which these slots have a V- or a Y-shaped section. These two geometries, or other geometries which are not shown, may be combined inside one and the same set of slots.

The material used for filling the slots (35) may be an elastic material, such as rubber, or a polyurethane elastomer. In this case, when the ski bends, the walls of one and the same slot (35) tend to close together, compressing the material (36) they contain. This material (36) thus tends to oppose this deformation. When the cause of the bending disappears, i.e. when the ski is again flat, particularly after the impulsion imparted by the skier in order to initiate a turn, the material (36) tends to give rise to the spacing-apart of the walls of the slots (35) and thus a more rapid return of the board into position, toward its initial curvature. Initial curvature is understood to mean the curvature of the board when the ski is weighted only by the skier's weight, statically.

Of course, the various slots (35) may be filled with a material which also has viscoelastic properties, such as VIBTENE in this case, the zone which includes the plurality of slots has damping properties.

Figure 8:
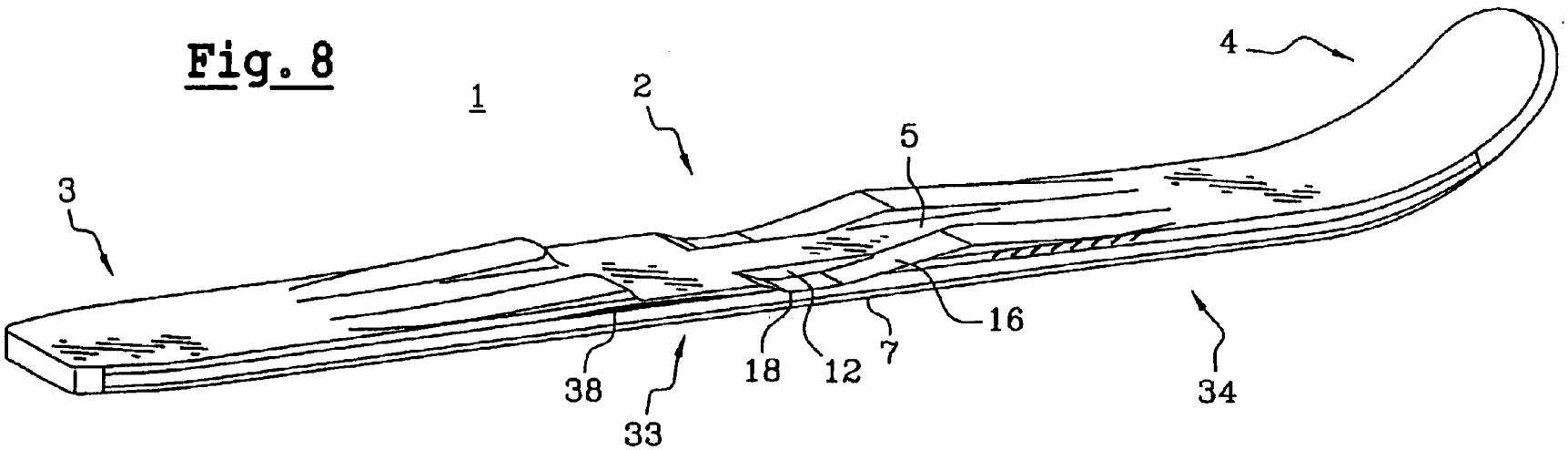
FIG. 8 is a summary perspective view of another variant embodiment.

Of course, the invention covers the various variant embodiments of the positioning of the damping and dynamizing zones described above. Thus, as illustrated in FIG. 8, the board includes a zone (34) which comprises parallel slots arranged to the front of the recess (12). This board also comprises a spindle piece (38) arranged to the rear of the recess (12).

In certain variant embodiments, it is possible to use two zones which include slots such as those described previously, one of these zones being located to the front of the recess and the other being located to the rear.

In the same way, the ski may also include two different spindle pieces, these being located one to the front of the recess and the other to the rear.

Figure 9:
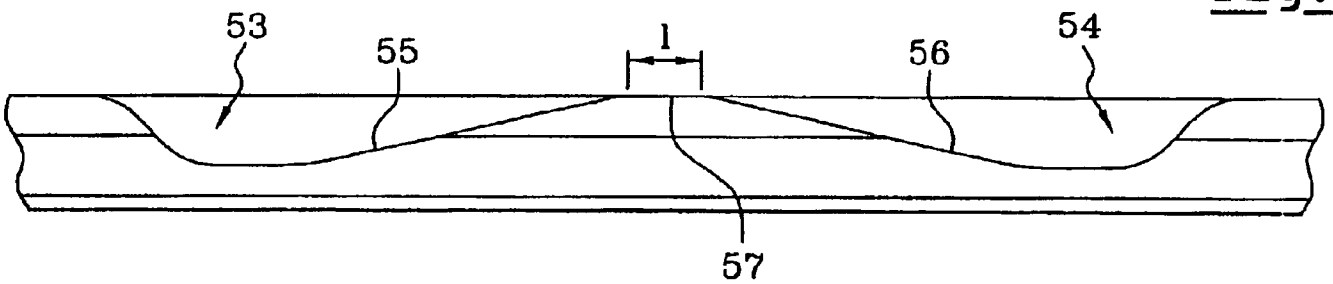
FIG. 9 is a side view of another variant embodiment.

Another variant embodiment is illustrated diagramatically in FIG. 9. In this case, the board has two recesses (53, 54) made on each of the sides of the board. Each of these recesses (53, 54) has a design similar to those described above. In the particular embodiment illustrated, the base (55) of the front recess (53) has a gradient that is oriented toward the bottom and toward the front. The base (56) of the rear recess (54) has a gradient that is oriented toward the top and toward the front (or, in an equivalent manner, toward the bottom and toward the rear).

The length (|) of the substantially horizontal portion (57) separating the two recesses (53, 54) can vary as a function of the slopes and the lengths of the recesses (53, 54). It may even be reduced to a zero value, so that these two recesses are then contiguous.

It emerges from the aforesaid that the board for gliding according to the invention offers numerous advantages and, in particular, a distribution of the stiffness in the underfoot zone which makes it possible to concentrate maximum power in the region of the edges and thus maximum gripping of the ski under the foot during the initiation of a turn.

Moreover, if the gradient of the characteristic recess is oriented toward the front and toward the top, as in the embodiments illustrated, moving of the pressure of the bearing points toward the front of the ski during the turn and thus an improvement in the actual execution of the turn are observed.

What is claimed is:

1. A board for gliding for downhill skiing, said board comprising:

a lower gliding surface comprising a sole plate bordered by metal edges;

a topsheet, said topsheet being a substantially parallel to the lower gliding surface, on either side of the center longitudinal plane of the board;

said topsheet comprising an underfoot zone, said underfoot zone being located in the central longitudinal plane of the board to allow it in receive a binding and said underfoot zone being configured to receive the binding;

lateral reinforcement elements located in line with at least one part of a bead of the metal edges;

lateral faces extending between the top part of the lateral reinforcement elements and the topsheet, said lateral faces having recesses located below the plane of the topsheet and said recesses opening out in the topsheet;

said recesses located in said underfoot zone, wherein said recesses form a hollowed zone connected to the reinforcement elements, and wherein a lower part of the recesses has a slope that is inclined longitudinally relative to the lower gliding surface and the topsheet; and wherein said lower part of said recesses comprises a central portion wherein said central portion is inclined longitudinally relative to the lower gliding surface and the topsheet.

2. The board for gliding as claimed in claim 1, wherein the lower part of the recesses is inclined toward the front and the bottom of the board.

3. The board for gliding as claimed in claim 1, wherein the lower part of the recesses is inclined toward the rear and the bottom of the board.

4. The board for gliding as claimed in claim 1, wherein the lower part of the recesses has a slope that is substantially constant over the greater part of its length.

5. The board for gliding as claimed in claim 1, wherein the lower part of the recesses has a slope that can vary over is length.

6. The board for gliding as claimed in claim 1, further comprising lateral zones to the front and to the rear of the recesses, the lateral zones including different materials.

7. The board for gliding as claimed in claim 6, wherein one of the materials present in one of the lateral zones is of a viscoelastic nature, so as to confer damping properties on said lateral zone.

8. The board for gliding as claimed in claim 7, wherein the viscoelastic material forms a spindle piece arranged above the lateral reinforcement element.

9. The board for gliding as claimed in claim 7, wherein the lateral zone having damping properties is located to the front of the recess, the lateral zone comprising an elastic material being located to the rear of the recess.

10. The board for gliding as claimed in claim 7, wherein the lateral zone having damping properties is located to the rear of the recess, the lateral zone comprising an elastic material being located to the front of the recess.

11. The board for gliding as claimed in claim 6, wherein one of the materials present in one at the lateral zones comprises an elastic material.

12. The board for gliding as claimed in claim 11, wherein the elastic material forms several elements located inside slots, made in the lateral zone.

13. The board for gliding as claimed in claim 11, wherein the lateral zone having damping properties is located to the front of the recess, the lateral zone comprising an elastic material being located to the rear of the recess.

14. The board for gliding as claimed in claim 11, wherein the lateral zone having damping properties is located to the rear of the recess, the lateral zone comprising an elastic material being located to the front of the recess.

15. The board for gliding as claimed in claim 1, which includes, on each lateral face, two recesses of which the base forms a slope that is inclined longitudinally relative to the lower gliding surface.

16. The system of claim 1 wherein said underfoot zone comprises a binding receiving portion and wherein said recesses are located below said binding receiving portion.

17. The board of claim 16 wherein said recesses are separated from one another in a transverse direction relative to the board by the topsheet.

18. The board of claim 1 wherein said lower part of said recesses comprises a plurality of lower parts, said plurality of lower parts comprising a first lower part inclined toward a front of the lower gliding surface and the top sheet and a second lower part inclined toward a rear of the lower gliding surface and the topsheet, and wherein said first part is inclined toward the front of the lower gliding surface and the topsheet at an angle different than the second part is inclined toward the rear of the lower gliding surface and the topsheet.

19. The board of claim 1 wherein said lower part of said recesses comprises a lowermost point and wherein said lowermost point forms a limit betwen a first portion inclined toward a front of the lower gliding surface and the top sheet and a second portion inclined toward a rear of the lower gliding surface and the topsheet.

20. The board of claim 19 wherein said lowermost point is longitudinally located along said recess at a distance further from the front end of the recess than from a rear end of said recess.

21. The board of claim 19 wherein said lowermost point is longitudinally located along said recess at a distance further from the rear end of the recess than from a front end of said recess.

22. The board of claim 1 wherein said recesses comprises a plurality of lower surfaces and wherein said lower part is one of said surfaces, and wherein said lower part is separated from said topsheet by another surface of said surfaces.

23. The board of claim 1 wherein said recesses are bounded on three sides.

24. The board of claim 23 wherein said recesses are bounded on at least two sides by said reinforcement elements.

25. The board of claim 1 wherein said central portion is separated from said topsheet by inclined longitudinal portions.

26. The board of claim 1 wherein said recesses are bounded by said reinforcement elements and said lateral faces.

* * * * *

UNITED STATES PATENT AND TRADEMARK OFFICE

CERTIFICATE OF CORRECTION

PATENT NO. : 7,021,648 B2
APPLICATION NO. : 10/078910
DATED : April 4, 2006
INVENTOR(S) : Deborde et al.

It is certified that error appears in the above-identified patent and that said Letters Patent is hereby corrected as shown below:

Claim 19

Col. 8, line 21, delete the word "betwen" after the word "limit" and insert --between--

Signed and Sealed this

Twenty-fifth Day of July, 2006

JON W. DUDAS
*Director of the United States Patent and Trademark Office*